52-20

10/22/85 XR 4,548,230

SR

United States Patent [19]

Feit

[11] Patent Number: 4,548,230

[45] Date of Patent: Oct. 22, 1985

[54] SURFACE BOX

[76] Inventor: Josef Feit, St. Veit-Strasse 7, D-8488 Erbendorf, Fed. Rep. of Germany

[21] Appl. No.: 576,240

[22] Filed: Feb. 1, 1984

[30] Foreign Application Priority Data

Feb. 28, 1983 [DE] Fed. Rep. of Germany ..... 3307017

[51] Int. Cl.[4] ..... F16L 5/00

[52] U.S. Cl. ..... 137/369; 137/370; 137/371; 52/20

[58] Field of Search ..... 137/368, 369, 370, 371; 52/20

[56] References Cited

U.S. PATENT DOCUMENTS

| | | | |
|---|---|---|---|
| 961,178 | 6/1910 | Tyler | 137/369 |
| 1,291,497 | 7/1916 | Dauphinee | 137/371 |
| 3,561,470 | 2/1971 | Hawle | 137/371 |
| 4,325,405 | 4/1982 | Christo | 137/371 |

FOREIGN PATENT DOCUMENTS

| | | | |
|---|---|---|---|
| 2910598 | 9/1980 | Fed. Rep. of Germany | 137/371 |
| 21560 | 10/1903 | United Kingdom | 137/371 |

*Primary Examiner*—A. Michael Chambers
*Attorney, Agent, or Firm*—Birch, Stewart, Kolasch & Birch

[57] ABSTRACT

A surface box for covering over and guarding the operating rod of a gate or other valve in underground piping has a tube-like supporting frame and a rod guard sleeve mounted therein so that it may be moved upwards and downwards in translation for adjustment, for which purpose it is supported by a thrust screw on the supporting frame. To keep the sleeve from being tilted sideways and the operating rod of the valve damaged, the rod guard sleeve is keyed in the supporting frame and is guided by at least one guide ridge in the frame.

23 Claims, 4 Drawing Figures

SURFACE BOX

BACKGROUND OF THE INVENTION

The present invention is with respect to surface boxes for gate valves with operating rods as fitted to underground piping, more specially water pipes, with a tube-like supporting frame and rod guard sleeve placed therein so that it is supported in relation to the frame by a thrust screw.

An account of a known design of such surface boxes is to be seen in the German Offenlegungsschrift specification No. 2,910,598. They are used for housing the driving rod of a gate valve fitted to piping laid under the ground so that when desired the cover of the box may be opened and the rod may be worked for opening or shutting the valve. In the case of the known surface box the rod guard sleeve in the supporting frame is controlled in its position therein by a thrust screw so that the rod guard sleeve may be moved lengthways and changed in position without moving the supporting frame in order to make allowances for settlement of the highway or for other purposes. However, it has been seen from experience that such a surface box has a number of shortcomings which might be taken care of, even though the design generally is not without its useful effects. In fact, one trouble likely to be experienced with such surface boxes is that the weight of vehicles driving over the box is the cause of great static and dynamic forces that have to be taken up by the surface box and transmitted to the foundation so that the rod guard sleeve is likely to be pushed sideways. Furthermore, the thrust screw will then no longer be at the right position of adjustment, this in turn being likely to be responsible for damage to the valve operating rod placed inside the supporting frame. At the same time there will be the further danger of the level of the rod guard sleeve in relation to the supporting frame changing so that the surface box will no longer be lined up with the surface of the highway.

SHORT OUTLINE OF THE PRESENT INVENTION

One purpose or object of the present invention is that of designing a surface box such that the forces produced by vehicles driving thereover may be transmitted to the foundation without the danger of damage to the valve operating rod in the surface box.

A further object of the invention is that of designing such a surface box that is resistant to the weight of vehicles driving over it in the sense that it will not be damaged by such forces, while nevertheless making possible simple adjustment of the position of the surface box to be line with the surface of the highway.

For effecting these and other purposes the surface box is so designed that the rod guard sleeve itself is slidingly keyed within the supporting frame, and there is at least one guide ridge to keep the rod guard sleeve from being tilted sideways in the supporting frame. Because the rod guard sleeve is keyed in the supporting frame so that it may not be turned in relation thereto but nevertheless may moved in the direction of the length of the supporting frame, it is possible to be certain that the rod guard sleeve together with the thrust screw maintains a certain angle about the axis of the box independent of the level of the road surface and there is then no possible chance of the valve operating or driving rod being damaged. The fact that the sleeve is mounted in the supporting frame so that it may not be rocked or tilted makes a useful contribution in this respect. Because such a design makes it impossible for the rod guard sleeve to be tilted or rocked sideways, one may furthermore be certain that the load of vehicles driving over the surface box will be transmitted by the supporting frame to the foundation in exactly the designed manner. Because the rod sleeve is mounted so that it is not able to be tilted, it becomes simpler to make an adjustment in the level of the surface box or of the rod sleeve because there will generally be no friction as might otherwise be caused by such a tilted position. In this connection a further important point is that the support frame is best bedded within the antifrost layer so that it may not be twisted. A preferred way of doing this is to have a flat on the outer face of the supporting frame. There will then be no troubles caused through hollows or pockets being produced about the supporting frame, that is to say there is no chance of the frame working loose in the material about it. Because the supporting frame is firmly seated, the position in relation to the valve operating rod within the box will be kept unchanged even when an adjustment is made to the level of the surface box so that from this quarter as well there is no danger to the rod of the gate valve. The supporting frame has the function of supporting and guiding the thrust screw and the valve operating rod so that if, as is best, the thrust plate and the supporting frame are made in one piece, there will be no possible chance of the thrust plate being rocked or tilted.

A more specially useful effect may be produced with respect to taking up the forces caused by vehicles driving over the surface box if the thrust screw is placed as near as possible to the lengthways or longitudinal axis of the supporting frame. The best way in this respect of stopping the thrust screw being pushed out of place under the effect of such forces is for the thrust screw to have a pocket in its lower end face so that it may be slipped over an upwardly pointing keeper peg on the floor of the supporting frame.

Because of the flat on the rod guard sleeve and because in other respects the rod guard sleeve has an even cylindrical outer face it is possible for the rod guard sleeve to be lowered further down into the ground at any time for adjustment in level, something that would not be possible if the rod guard sleeve were to be made with a bead round it. For guiding the rod guard sleeve within the supporting frame so that the rod guard sleeve may not be rocked or tilted it is best for the supporting frame to have guide ridges or lips on its inner face, said lips being spaced in the circumferential direction. Such guide lips or ridges, forming between them pockets to take up any dirt or debris falling into the supporting frame, make the supporting frame more rigid. A useful effect may be produced if the guide lips are in line with the guide surface of the guide shoulder, they then furthermore function as guide faces for the rod guard sleeve so that adjustment in level is made simpler; it may be undertaken simply by turning the thrust screw because the rod guard sleeve is locked in place. A further useful effect is produced if the cover is keyed (that is to say locked against being twisted) within the rod guard sleeve so that there is no chance of its being turned and working loose under the weight of vehicles driving thereover. In this case as well the cover is best keyed in place by its having a flat. It is furthermore best for the cover to have a pin fitting into a hole therefor in an inner ledge or shelf of the rod guard sleeve.

Further details and useful effects of the invention will be seen from the account now to be given of working examples using the figures.

LIST OF THE DIFFERENT VIEWS OF THE FIGURES

DETAILED ACCOUNT OF WORKING EXAMPLES OF THE INVENTION

Figure 1:
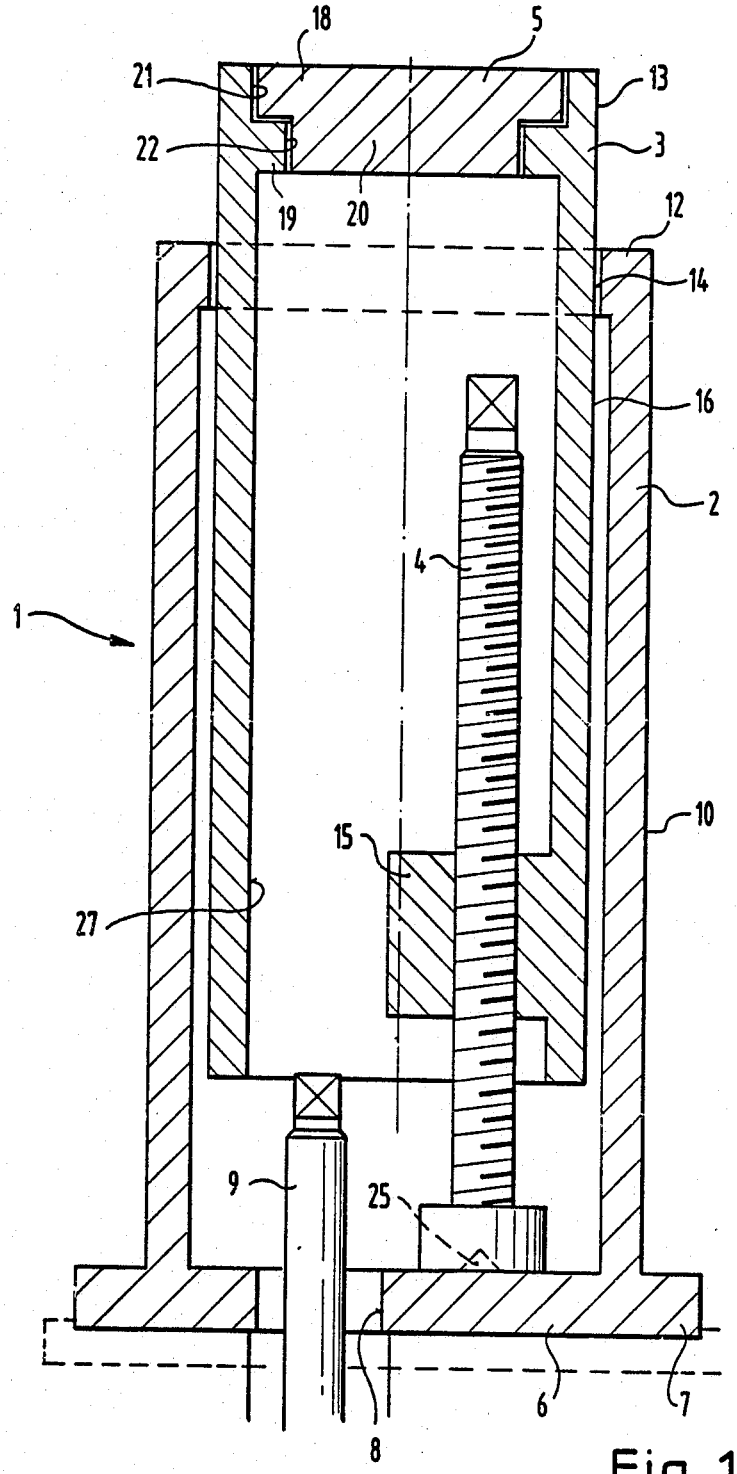
FIG. 1 is a diagrammatic section and view of a working example of a surface box.

In keeping with FIG. 1 a surface box, generally numbered 1, has a supporting frame 2, a rod guard sleeve 3 mounted and guided therein for motion in its lengthways direction, a thrust screw 4 supporting the rod guard sleeve on the supporting frame and a cover 5 seated within the top end of the rod guard sleeve.

The supporting frame 2 has a floor or thrust plate 6 and a supporting frame ledge 7 running out from the lower end thereof. The thrust plate 6 of the supporting frame 2 has an opening for the valve operating rod 9. In comparison with the valve operating rod 9 the opening 8 has a large diameter and, as will be seen from FIG. 1, the opening is eccentric in the supporting frame 2. In keeping with the invention the supporting frame 2 is firmly seated in an antifrost layer and for stopping it being twisted the supporting frame 2 has polygonal outer face 10 or is made unround or non-cylindrical in some other way. However, in keeping with a preferred form of the invention to be seen in the section of FIG. 2 the outer face 10 has a flat 11, same keying the supporting frame 2 within the antifrost layer so that it is firmly seated in place and will not be moved out of position even when acted upon by outside forces. This keyed or interlocking seat of the supporting frame in place is needed for stopping hollows from being formed round the box and stopping any damage to the valve operating rod 9 running upwards through the opening 8 in the thrust plate 6 and into the inside of the support frame 2. As will be seen quite clearly from FIG. 2, the flat 11 is designed stretching right along the length of the supporting frame 2 so that it is present on the ledge 7 as well.

The rod guard sleeve 3 is guided by a guide shoulder 12 in the top end of the supporting frame 2, there being a small amount of play between the shoulder and the rod guard sleeve 3, the shoulder 12 running only a small distance into the inside of the supporting frame 2 and preferably being all the way around its inner surface. Because there is only a small ring-like gap 14 between the guide shoulder 12 and the rest of the smooth outer face 13 of the rod guard sleeve 3, it is not possible for the space between the rod guard sleeve 3 and the supporting frame 2 to be fouled by loose road making material. If anything, there is only a chance of very fine grains of bituminous material placed on the antifrost layer dropping down through the space and collecting in the space between the supporting frame 2 and the rod guard sleeve 3 however, this material will be so small in amount that it is hardly likely to cause the rod guard sleeve 3 to jam in the supporting frame 2.

The rod guard sleeve 3 is supported in relation to the supporting frame 2 by the thrust screw 4 whose male screw thread is taken up in a threaded eccentric hole in a ledge 15 within the rod guard sleeve 3. As may be readily seen from FIG. 1, the entire thrust screw 4 is placed eccentrically in the supporting frame, such eccentricity however being as small as possible so that the forces acting on the rod guard sleeve 3 are efficiently transmitted to the supporting frame 2.

Figure 2:
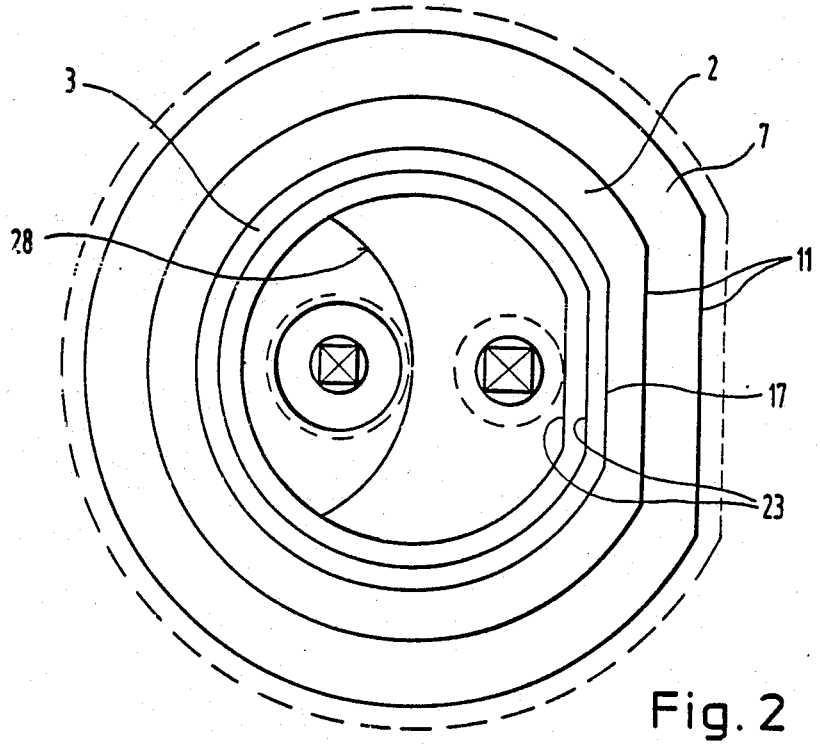
FIG. 2 is a plan view of the surface box as presented in FIG. 1.

The rod guard sleeve 3 is keyed within the supporting frame 2, that is to say so mounted that it may not be twisted, to which end in the design of FIG. 1 the outer circumferential face 16 has a flat 17 to be seen in more detail in FIG. 2. In keeping with this, the supporting frame 2 has a inner flat 12 on which the shoulder 12 is positioned. But for the presence of the flat the outer face of the rod guard sleeve 3 is evenly cylindrical for its full length on the two sides of the flat 17. The smooth outer circumferential face of the rod guard sleeve 3 is important to make it possible for the rod guard sleeve 3 to be moved downwards even though it has bituminous material on all sides.

The cover 5 has two means for keeping it in position. On the one hand the cover 5 has a ring-like shoulder 18 resting on a mating ring-like ledge 19 in the top end of the rod guard sleeve 3. The part 20 of the cover 5 under the shoulder 18 is taken up with a small amount of play in the opening within the ring-like ledge 19 on the top inner wall of the rod guard sleeve 3. For keying the cover the two inner surfaces 21 and 22 of the rod guard sleeve 3 opposite the cover 5 and the faces on the cover 5 opposite thereto have a flat 23, as may be seen in FIG. 2. This makes it impossible for the cover 5 to be turned by the weight of the vehicles running over it and worked loose. Such a chance of the cover working loose is otherwise always present in the case of strong sunshine causing the bitumen to become soft so that pieces of it are taken up on the tires of vehicles, same then pulling out the cover when running over it because of the sticky nature of the bitumen. As seen from FIG. 3, a further means to keep the cover 5 in place in the rod guard sleeve 3 is the use of a pin on the same running into a hole 24 in the ring-like ledge 19.

In order to keep the rod guard sleeve 3 from working loose and coming out of place and to keep the thrust screw 4 from wandering, even to a small degree, on the thrust plate 6, the thrust screw 4 is seated on a keeper peg 25, that is best pointed. The foot of the thrust screw 4 has a pointed pocket within it so that it may be fitted onto the keeper peg, as will be clearly seen in FIG. 3.

Figure 3:
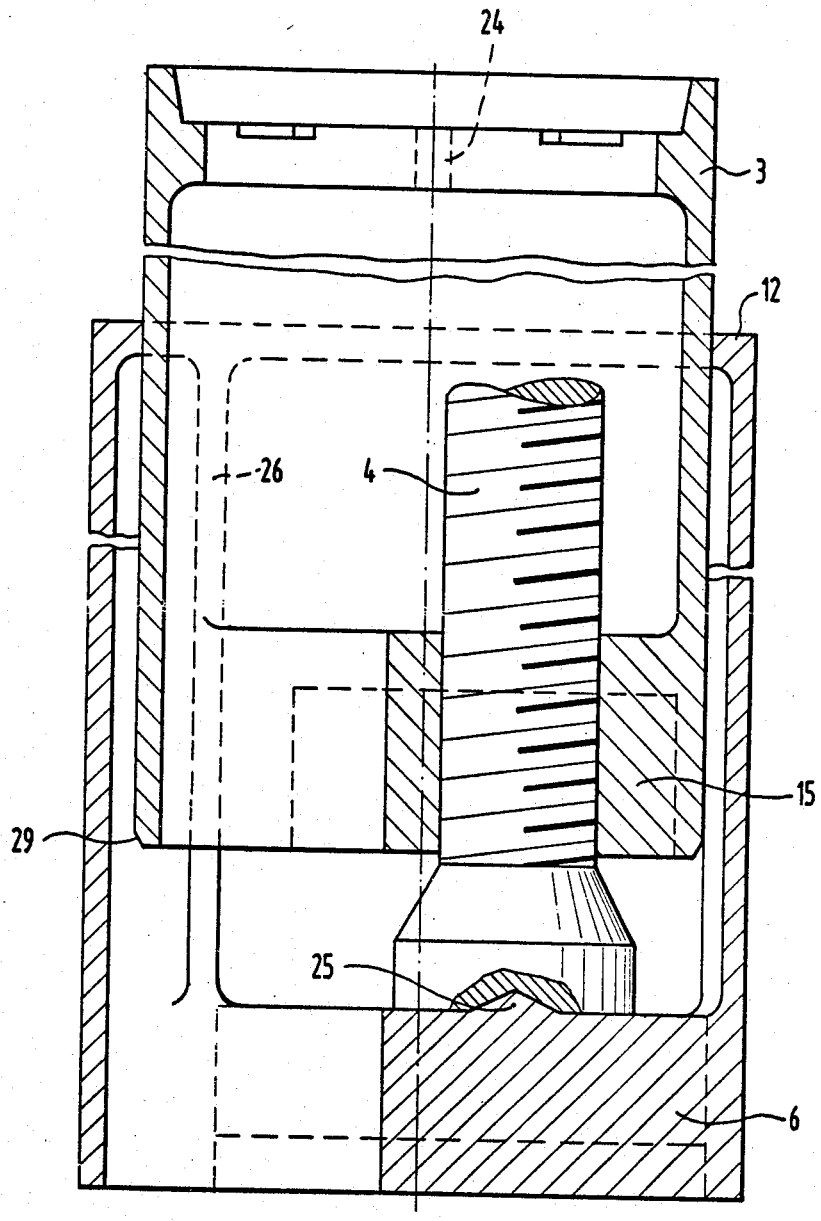
FIG. 3 is a section view of a further working example of the surface box.

The form of the invention to be seen in FIG. 3 is generally based on the same idea as that of FIG. 1, that is diagrammatic, but however FIG. 3 is more detailed. In this form of the invention the supporting frame 2 has guide lips 26 or ridges on its inner face running down as far as the floor plate 6 and best being made with the supporting frame 2 as one piece of material. At their top ends the guide lips 26 are joined with the guide shoulder 12, the guide faces of the guide lips 26 and of the ring-like shoulder 12 being in line with each other. The purpose of the guide lips is to keep the rod guard sleeve 3 from being tilted sideways even to the very least degree in relation to the supporting frame 2. As may be seen quite clearly from FIG. 4, the guide lips 26 are spaced out round the inner face of the supporting frame and in this figure two guide lips 26 are placed next to the flat on the supporting frame 2 and the two other guide lips 26 are placed so as to be somewhat short of being diametrally opposite the first-noted lips 26. Pockets are formed between the lips 26 and between the lips and the top guide ledge, such pockets trapping any dirt working its way into the surface box by way of the gap 14.

Figure 4:
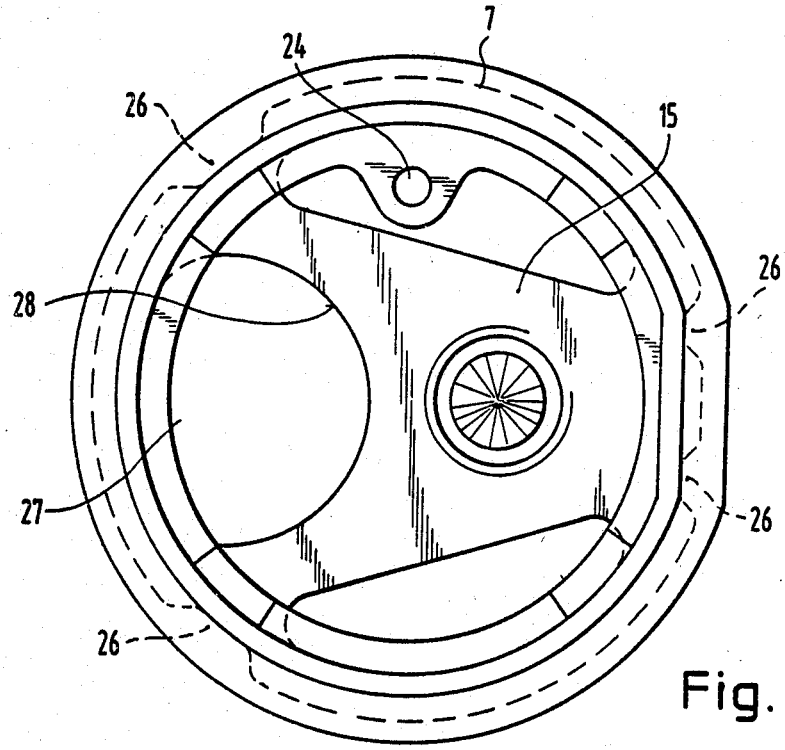
FIG. 4 is a plan view of the surface box as in FIG. 3 after taking off the cover.

As will be quite clearly seen from FIG. 4 and furthermore FIG. 2, the inner ledge 15 with the thrust screw 4 screwed into it is well spaced from the opposite inner wall face of the rod guard sleeve 3 so that there is a large opening for the valve operating rod 9 to be put through. In fact the opening is so large that there is not the least chance of the valve's operating rod 9 being damaged by parts of the rod guard sleeve 3. In the working example of the invention figured the opening 26 for the operating rod 9 has a round (FIG. 2) or elliptic (FIG. 4) form at 28 at the side.

It will furthermore be clear from FIG. 3 that the rod guard sleeve 3 has a sloping face 29 at its lower end so that it is simpler for the rod guard sleeve 3 to be slipped into the supporting frame 2.

I claim:

1. A surface box for a valve fitted in underground piping, said valve having an operating rod, comprising a tube-like supporting frame, a rod guard sleeve slidingly positioned in said supporting frame, a thrust screw for supporting said rod guard sleeve on said supporting frame, said rod guard sleeve being keyed within said supporting frame, said rod guard sleeve and supporting frame including tortion-resistant means for preventing rotation of said rod guard sleeve relative to said supporting frame and at least one guide ridge for preventing said rod guard sleeve from tilting in said supporting frame.

2. The surface box as claimed in claim 1 wherein said tortion-resistant means comprises an outer face of said rod guard sleeve having at least one first flat portion running along a distance thereon equal to the amount of sliding motion of the rod guard sleeve, and said supporting frame having a second flat portion mating with said first flat portion.

3. The surface box as claimed in claim 2 wherein the outer face of the rod guard sleeve is cylindrical in form but for the presence of the said first flat portion thereon, said cylindrical form running from one end of the said rod guard sleeve to an opposite end of it.

4. The surface box as claimed in claim 2 wherein the second flat portion on the supporting frame is formed on a guide shoulder for guiding said rod guard sleeve.

5. The surface box as claimed in claim 1 comprising more than one such guide ridge, such ridges being spaced from each other circumferentially about said rod.

6. The surface box as claimed in claim 5 wherein said ridges are on an inner face of said supporting frame.

7. The surface box as claimed in claim 6 wherein the second flat portion on the supporting frame is formed on a guide shoulder for guiding said rod guard sleeve, said guide ridges having inner faces lined up with a guiding face on said shoulder.

8. The surface box as claimed in claim 7 wherein said guide ridges are made in one piece with said supporting frame and have top ends joined with said guide shoulder.

9. The surface box as claimed in claim 8 having two such guide ridges placed opposite said flat portion on said rod guard sleeve and two further such guide ridges being placed opposite thereto but at positions short of diametrally opposite ones.

10. The surface box as claimed in claim 9 wherein dirt take-up pockets are formed between said guide shoulder and the guide ridges and between the guide ridges themselves.

11. The surface box as claimed in claim 2 wherein said supporting frame has an outer face having a flat portion running along the length thereof.

12. The surface box as claimed in claim 1 wherein said supporting frame has a polygonal-prismatic outer face.

13. The surface box as claimed in claim 1 comprising a thrust plate and a bearing means thereon for use with a lower end of said thrust screw.

14. The surface box as claimed in claim 13 wherein said bearing means comprises a keeper peg on said thrust plate fitting into a pocket in the said lower end of said thrust screw.

15. The surface box as claimed in claim 1 wherein said thrust screw is eccentric within said supporting frame by a minimum distance from a lengthways middle axis of said supporting frame.

16. The surface box as claimed in claim 1 comprising a generally level ledge within and fixed to said rod guard sleeve, said ledge having a threaded hole therein into which said thrust screw is screwed, said ledge being spaced from an opposite inner wall face of said rod guard sleeve to give a large opening to take up the operating rod of said valve.

17. The surface box as claimed in claim 16 wherein said opening for said operating rod has a curved limit running round said ledge.

18. The surface box as claimed in claim 17 wherein said rod guard sleeve has an outer sloping face at its lower end for guiding it into said supporting frame on assembly thereof.

19. The surface box as claimed in claim 1 comprising a cover with a flat portion for fitting against a mating flat portion at the edge of an opening in the top end of the said rod guard sleeve.

20. The surface box as claimed in claim 19 wherein said cover has a part of greater diameter fitting on a ring-like ledge at the top end of and within said rod guard sleeve, said cover having a part of smaller diameter under said part with greater diameter to be taken up within said ring-like ledge.

21. The surface box as claimed in claim 20 having a pin on said cover that is fitted into a hole in said ring-like ledge.

22. A surface box for a valve fitted in underground piping, said valve having an operating rod, comprising:

a tube-like supporting frame;

a rod guard sleeve slidingly positioned in said supporting frame;

a thrust screw for supporting said rod guard sleeve on said supporting frame;

said rod guard sleeve being keyed within said supporting frame;

said rod guard sleeve having at least one first flat portion along a distance thereon equal to the amount of sliding motion of the rod guard sleeving, and said supporting frame having a second flat portion mating with said first flat portion for preventing rotation of said rod guard sleeve relative to said supporting frame; and a plurality of guide ridges on the inner face of said supporting frame for preventing said rod guard sleeve from tilting in said support frame, said guide ridges being circumferentially spaced about said rod.

23. A surface box as in claim 22, wherein said box further includes dirt take-up pocket formed between said guide shoulder and the guide ridges and between the guide ridges themselves for collecting debris.

* * * * *